United States Patent [19]

Arnaudeau

[11] Patent Number: 4,625,744

[45] Date of Patent: Dec. 2, 1986

[54] PROCESS AND DEVICE FOR PERFORMING A SERIES OF HYDRODYNAMIC FUNCTIONS ON A FLOW COMPRISED OF AT LEAST TWO PHASES

[75] Inventor: Marcel Arnaudeau, Paris, France

[73] Assignee: Institut Francais du Petrole, Rueil-Malmaison, France

[21] Appl. No.: 540,351

[22] Filed: Oct. 11, 1983

[30] Foreign Application Priority Data

Oct. 11, 1982 [FR] France ..... 82 17122

[51] Int. Cl.[4] ..... F17D 3/00

[52] U.S. Cl. ..... 137/10; 137/173; 137/12; 137/894; 137/895

[58] Field of Search ..... 137/173, 174, 175, 894, 137/891, 895, 892, 893, 1, 2, 10, 12

[56] References Cited

U.S. PATENT DOCUMENTS 1,437,649 12/1922 Guelbaum ..... 137/625.4 X
3,416,547 12/1968 Glenn ..... 137/210 X

FOREIGN PATENT DOCUMENTS 2295593 8/1976 France .
2014862 9/1979 United Kingdom .

*Primary Examiner*—Alan Cohan
*Attorney, Agent, or Firm*—Antonelli, Terry & Wands

[57] ABSTRACT

A process for performing a series of hydrodynamic functions or operation on a flow of fluids comprised of at least two phases includes the following steps: separating the fluid phases that comprise the initial flow; reducing the turbulence of the flows of each of the fluid phases which have been separated from each other; and recombining the fluid phases to form a new polyphasic flow with a predetermined structure.

16 Claims, 2 Drawing Figures

PROCESS AND DEVICE FOR PERFORMING A SERIES OF HYDRODYNAMIC FUNCTIONS ON A FLOW COMPRISED OF AT LEAST TWO PHASES

This invention relates to a process and a device that make it possible to effect a series of hydrodynamic functions or operations on a flow comprised of at least two fluid phases, such as the functions of regulators, separators, stabilizers, integrated flowmeters, or heat exchangers.

In the following description, the terms "above" and "below" will relate implicitly to the device according to the invention by taking into account the direction of the flow of a fluid or stream. Thus, for example, the expression "upward flow" will refer to the flow that is directed toward the device under consideration and the term "downward flow" will refer to the flow away from the device.

Along a transfer line or conduit, the structure of a flow or stream comprised of at least two phases develops into forms that require more and more energy to keep the stream moving.

In some cases, the structure of the flow or stream can be such that it can no longer be compressed in certain pump models, for example, in the case of a liquid/gas diphasic stream when the size of the gaseous bubbles becomes large enough to drain the pump.

Furthermore, it is often necessary to known the composition of the diphasic mixture carried by a transfer line in order to better regulate the devices located on the line, for example, pumps.

The prior state of the art may be illustrated by French Pat. Nos. 2,299,593 and 2,401,862; British Pat. No. 2,014,862 and U.S. Pat. Nos. 3,416,547 and 1,437,649. None of these patents makes it possible to meet the abovementioned needs in a truly satisfactory manner.

This invention also provides a device that makes it possible to stabilize the upward flow, to regulate the downward flow, to generate a hydrodynamically defined flow with a polyphasic structure, and to measure the outflows of the different phases that comprise the flow under consideration.

Moreover, the device according to the invention, which consumes a small amount of energy, may be produced by integrating its various components into a compact unit which is small in volume.

It is also possible, according to the invention, to attach a heat exchanger to the device, in order to alter the temperature of the polyphasic mixture.

Thus, the invention consists of a process that makes it possible to perform a series of hydrodynamic functions on a flow comprised of at least two phases. The process, according to the invention, includes the following main steps:

- separation of the fluid phases that comprise the initial flow;
- turbulence reduction of the flows of each of said fluid phases; and
- recombination of said phases to form a new flow with a predetermined structure.

The recombination of the phase can be done by channeling at least one of the flows of the phases through at least one orifice or conduit of the adjustable channel-forming section.

The channel-forming section of this orifice is adjusted, if need be, as a function of at least one of the variables created by the flow rate, the pressure, the temperature of one of the fluid phases and the level of liquid in the turbulence reducer.

The channel-flowing section of this orifice may be adjusted as a function of previously set criteria, such as minimizing the loss of energy of the flow.

This invention also relates to a device that makes it possible to perform a series of hydrodynamic functions on a flow comprised of at least two phases.

The device according to the invention includes mainly at least one phase separator linked by pipes or conduits to a turbulence reducer, which itself is connected to a gas liquid ejector, through other pipes, at least one of which has a flowmeter. The ejector may be adjustable.

An adjustable throttling device may be set on at least one of the pipes that connects the turbulence reducer to the ejector.

The ejector may, if need be, have two convergent-divergent components with channel-flowing sections that can be adjusted independently of each other.

An automatic control component can regulate the operation of the ejector.

This component will be equipped to advantage with devices that send at least one signal which represents a piece of data, such as the flow rate of one of the fluids; i.e., one of the phases, the pressure or the temperature relative to one of the components of the device according to the invention, or the level of liquid in the turbulence reducer.

The automatic control component could include a motorization system and a programming system to control the various channel-forming sections of the ejector as a function of previously set criteria.

The stabilizer may be equipped to advantage with an exchanger.

The separator will have, if necessary, a device to enable draining the liquid or solid particles. This device is connected to a combustion opening into a supplemental discharge device or into a environment through a control mechanism and through a pipe opening at the outflow of the ejector through another control device.

In some case, both of the control mechanisms may be replaced by a three-track control mechanism.

The invention will be better understood and its advantages will appear more clearly through the following description of a nonlimiting embodiment for treating a diphasic mixture illustrated by the accompanying figures in which.

Figure 1:
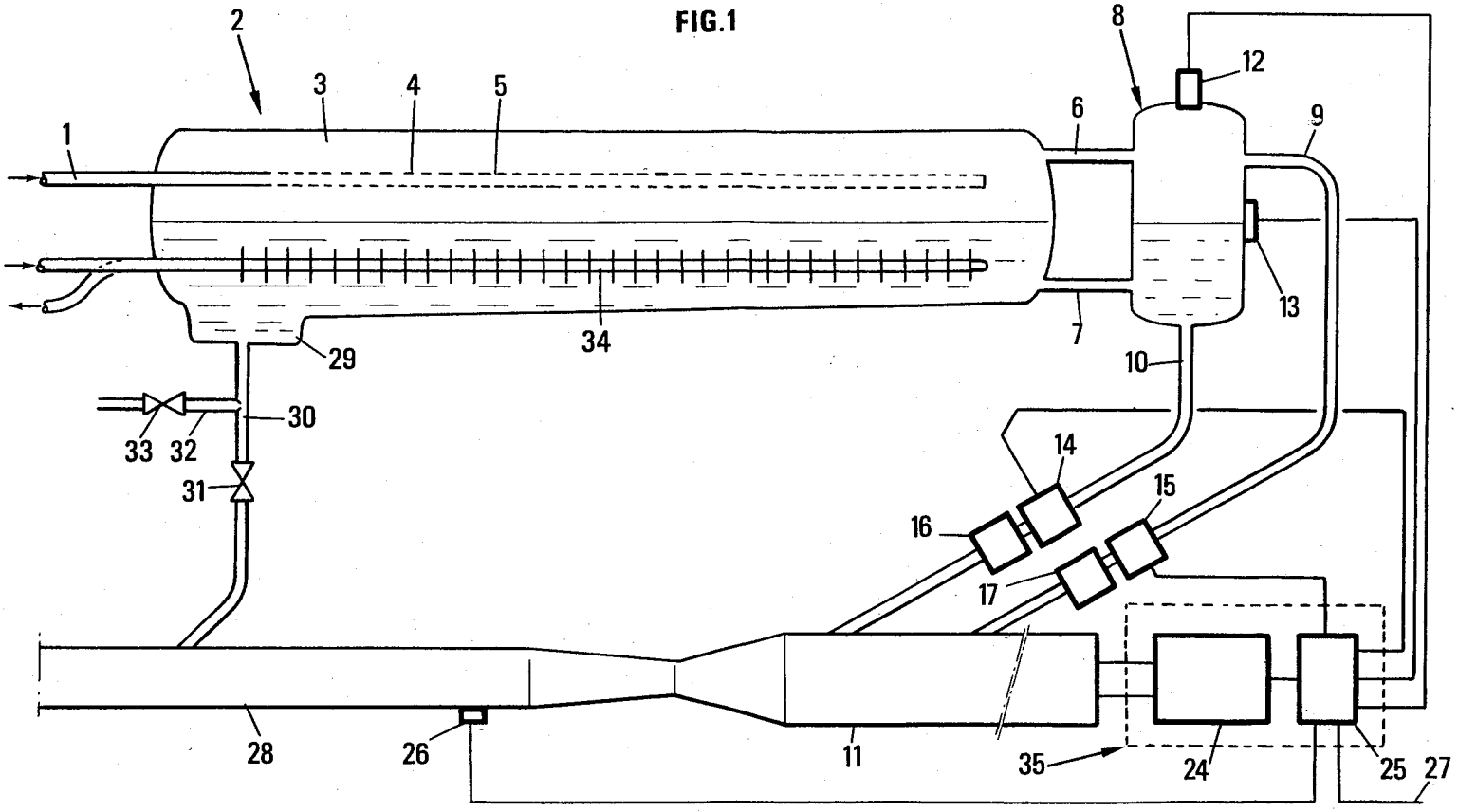
FIG. 1 shows a schematic view of the device according to the invention.

In FIG. 1, which provides an overall view of the device, reference numeral 1 represents the intake piping of a diphasic effluent stream.

The separator 2 has a chamber 3 in which a tube 4 is positioned that extends from the intake piping 1 of the diphasic mixture.

The tube 4 is provided with orifices along its length that may be of any shape.

As an example, the orifices may be circular and have a diameter anywhere between 4 and 6 millimeters for a tube of between 50 and 100 millimeters in diameter and for a tube or pipe of between 0.5 and 2 meters in length.

At least two pipes 6 and 7, the upper pipe 6, and the other lower pipe 7, connect the separator 2 to a turbulence reducer 8. Similarly, at least two pipes 9 and 10 connect the turbulence reducer to the ejector 11.

The turbulence reducer 8 may be equipped, if necessary, with a means 12 for measuring pressure and means 13 for measuring the liquid level.

On each of the pipes 9 and 10 that connect the turbulence reducer to the ejector, there is provided a flowmeter, respectively, 14 and 15. It is also possible to place adjustable throttling devices 16 and 17, respectively, on the pipes 9 and 10.

Figure 2:
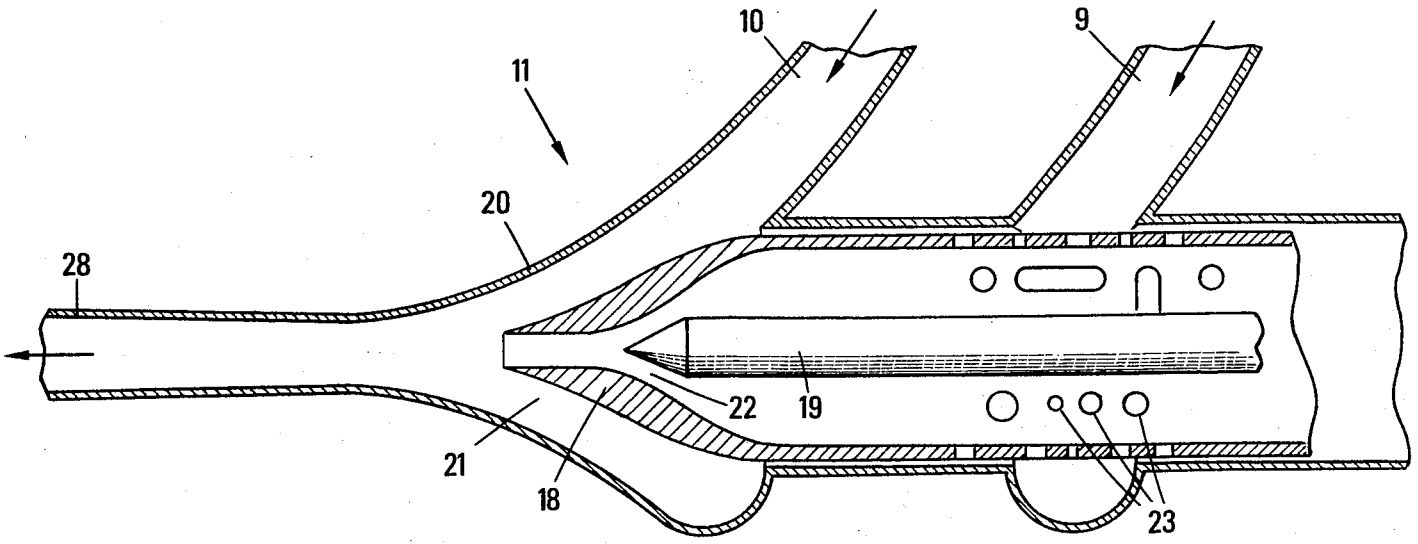
FIG. 2 shows a more detailed sectional view of the ejector.

The ejector 11 has two movable elements designated by numerals 18 and 19, respectively, in FIG. 2.

Element 19 is positioned inside element 18 which is hollow.

Along with the body of the ejector 20, the outer surface of one of the tips of element 18 defines one throttling means or orifice 21.

Along with the inner surface of the tip of element 18, element 19 defines another throttling means or orifice.

The shapes of the elements included in the body 20 of the ejector 11, of element 18 and of element 19, are produced in such a way that if element 18 is brought closer to the body 20, or element 19 is brought closer to element 19, the respective sections of the throttlings 21 and 22 become smaller.

In other words, element 18 forms a hollow needle-valve that operates together with the inner wall of body 20 of the ejector and element 19 forms a needle-valve that operates together with the inside wall of element 18.

The middle of element 18 is preferably of cylindrical shape and is provided along a certain length with orifices 23, if need be, in such a way that whatever the position of element 18 relative to the body of the ejector while the ejector is operating, there is a minimum channel section for the fluid that arrives through the pipe 10 and moves toward the hollow portion of element 18.

The relative position of element 18 in relation to that of the body 20 of the ejector, and that of element 19 relative to element 18, are, if need be, controlled from an automatic control system 35. This may include a motorization system 24 driven by the programming system 25.

The programming system 25 receives the measurements and the signals required for controlling the regulation system. The number and nature of these measurements and signals are, among other things, a function of the conditions of use of the device according to the invention. In fact, it is noted that when the device, according to the invention, is being used on a transfer line or flow conduit, that the information required for controlling the ejector will be a function of the various mechanisms that the line has, as well as a function of the degree of regulation desired.

However, and as a non-limiting example, different sensors have been illustrated in FIG. 1. Thus, other than the measurements supplied by the flowmeters 14 and 15, the programming system 25 receives the signals of the sensor that measure the pressure in the turbulence reducer (sensor 12), the liquid level in the turbulence reducer (sensor 13), and the pressure at the outlet 28 of the ejector (sensor 26).

Reference numeral 27 designates at least one line for supplying outside information and orders to the programming system.

The outside information supplied to the programming system 25 could, for example, involve the operating conditions of apparatus placed upstream and downstream of the device, or it may involve the nature of the compounds of the diphasic flow.

The outside orders that the programming system receives, which also establish the working conditions, will, for example, be the structure of the flow that is desired at the outlet of the ejector, the pressure desired at the outlet 28 of the ejector, flows to be transferred, etc.

If necessary, the system can provide outside information about its operation such as flow rates measured by the flowmeters 14 and 15, as well as pressures, temperatures, the position and the conditions of the ejector's operation.

If need be, the separator 2 has a mechanism that makes it possible to drain the liquid or solid particles. This mechanism has a low point or basin 29 provided in the separator, a pipe 30 that connects the low point through a control mechanism to the flow leading to the outlet 28 (for example, a valve 31), and a pipe 32 that connects the low point through a control device 33 to a discharge mechanism and quite simply, to the outside environment.

If necessary, a heat exchanger 34 set inside the separator will make it possible to alter the temperature of the diphasic mixture.

OPERATION

A diphasic mixture arrives through the pipe 1, enters into the stabilizer through the tube 4, where the liquid phase is separated from the gaseous phase. If there are any solid deposits, they are gathered at the low point 29 of the stabilizer.

The temperature of the liquid can be altered, if need be, by using the exchanger 35.

The gas is transferred through the conduit 6 into the turbulence reducer, as is the case for the liquid through the conduit 7.

In the turbulence reducer, the turbulence of the two phases is reduced, making it possible to measure the pressure of both as well as the liquid level.

The gaseous phase is transferred through the pipe 9 toward the ejector. The pipe 9 has a gas flowmeter which provides a signal representing the outflow to the programming system 25. The liquid phase is transferred through the pipe 10 toward the ejector. This pipe has a liquid flowmeter 14 and its signal is sent to the programming system 25.

Both pipes 9 and 10 have adjustable throttling devices 15 and 16, respectively, that make it possible, if required, to cause a slight loss of load to cover a wide gamut of flow rates with a flow-meter or a mechanism according to the invention.

By use of the various measurements, especially the flow rates and outside orders, the programming system 25 drives the motorization system 24, which controls the position of the ejector's movable elements in order to generate a diphasic flow with a determined structure. The structure ensures the optimal and stable operation of diphasic equipment set on a transfer line above; i.e., upstream, and below; i.e., downstream of the device, according to the invention.

The following is an example of the operation of the motorization 24 and programming 25 systems. Through the use of measurements supplied by flowmeters 14 and 15, the programming system 25 determines the pressure which must exist at the outlet 28 of the ejector in order to produce a resulting flow with the desired characteristics. As a function of the pressures measured by the pressure measurement mechanisms 12 and/or 26, the programming system 25 determines the movement of part 19 and orders said movement using the motorization system 24. Furthermore, the programming system orders the movement of part 18 so that the level of the liquid measured by the sensor 13 is largely constant. Of course, these various adjustments interfere with one another until they attain an equilibrium point. If the upward and/or downward conditions of the flow are altered, the programming system 25 orders new movements for parts 18 and 19 until a new equilibrium point is attained.

It is possible to invert the relative positions of the gas and water (liquid) intake pipe on the ejector without exceeding the scope of the invention.

Similarly, the scope of this invention is not exceeded by using a different type of ejector than the one previously described.

The programming system 25 may be a programmed microprocessor system.

The motorization system 24 may be of any known type, such as electric, pneumatic, etc.

The scope of this invention is not exceeded by applying the previously described process to fluids of the same nature but which tend to separate from one another, such as two liquids of different densities that are not miscible. The device, according to the invention, may also process this type of fluid.

Of course, the scope of this invention is not exceeded by introducing additional steps such as destabilizing the liquid phase or separating emulsions. The steps may, if required, be performed along with the steps provided by the invention; thus, desalinization can be performed in separator 2 at the same time the separation step is being performed.

What is claimed is:

1. A process for performing a series of hydrodynamic functions on a flow of fluids comprised of at least two phases which comprises the following steps: effecting separation of the fluid phases that comprise the initial flow; effecting turbulence reduction of the flows of each of said fluid phases separated from each other; and effecting recombination of said fluid phases to form a new polyphasic flow with a predetermined structure; said fluid phases comprising a gas phase and a liquid phase; separation of the liquid and gas being effected in a vessel to provide a liquid level therein with a gas over the liquid; said turbulence reduction being effected in a separate vessel also having the same liquid level therein; said recombination of said gas and liquid phases being effected by controlled gravity flow of the liquid to an ejector means as well as controlled flow of the gas to said ejector means whereby a desired gas-flow mixture is discharged from the ejector means to provide said predetermined polyphasic structure.

2. A process according to claim 1, wherein the recombination of said phases to form a new flow is performed by channeling at least one of the said flows of the phases through at least one orifice of said ejector means provided with an adjustable cross-section.

3. A process according to claim 2, wherein the channel-forming section of said orifice is adjusted as a function of at least one of the variables formed by the flow rate, pressure, temperature of the fluids and level of the liquid in the turbulence reducer.

4. A process according to claim 2, wherein the channel-forming section of said orifice is adjusted as a function of preestablished criteria, thereby minimizing the loss of energy of the flow.

5. A process according to claim 3, wherein the channel-forming section of said orifice is adjusted as a function of preestablished criteria, such as minimizing the loss of energy of the flow.

6. A device for allowing a set of hydrodynamic functions to be performed on a flow of fluids comprised of at least two phases, which comprises at least one phase separator connected by pipes to a means for reducing turbulence which is connected to a gas-liquid ejector means through at least two pipes, at least one of which has a flowmeter provided therein; the at least two pipes connected to the ejector means being free of pump means; said ejector means having two convergent mechanisms with channel-forming sections that can be adjusted independently of one another.

7. A device according to claim 6, wherein at least one adjustable throttling device is provided in one of the pipes that connect the turbulence reducing means to the ejector means.

8. A device according to claim 6, further comprising an automatic control mechanism for controlling the ejector means.

9. A device according to claim 8, further comprising signal generating means that send to said automatic control mechanism at least one signal that represents a piece of information representative of the flow rate of one of the fluids, the pressure or the temperature relative to one of the components of said device, or the level of liquid in the turbulence reducing means.

10. A device according to claim 8, wherein said automatic control mechanism has a motorization system that controls the various channel sections of the ejector means as a function of previously established criteria.

11. A device according to claim 9, wherein said automatic control mechanism has a motorization system that controls the various channel sections of the ejector means as a function of previously established criteria.

12. A device according to claim 6, characterized in that the phase separator has a heat exchanger positioned therein for altering the temperature of the diphasic mixture.

13. A device according to claim 6, characterized in that the phase separator has a means for draining liquids or solid particles, said means being connected to a pipe that opens toward a connected discharge device or toward the environment, through a control device and to a pipe that opens at an outlet of the ejector means through a flow control device.

14. A device for forming a series of hydrodynamic functions on a flow of a diphasic mixture of gas and liquid which comprises a phase separator for separating the diphasic mixture of gas and liquid into separate phases; means for introducing the diphasic mixture of gas and liquid into said phase separator at preselected flow conditions including flow rate and pressure; pipe means for connecting the phase separator to means for reducing turbulence in the flow of gas and liquid phases, said pipe means including one pipe for conveying the gas and another pipe for conveying the liquid into said means for reducing turbulence whereby the means for reducing the turbulence has a liquid level identical to that in the phase separator; a gas-liquid ejector means; pipe means for connecting the gas-liquid ejector means to the means for reducing turbulence and for conveying the gas and liquid phases thereto without pump means, one of said pipes having a flowmeter therein; and control means for maintaining a constant liquid level in said means for reducing turbulence and said phase separator, said control means including means for regulating the separate flows of the gas phase and the liquid phase into the said ejector means whereby the structure of the resulting multiphase mixture of gas and liquid discharged from the ejector means can be regulated to have a desired structure; the flow of liquid to said ejector means being promoted by gravity feed alone.

15. A device according to claim 14, wherein said control means includes signal generating means that provide at least one signal representative of the flow rate or pressure of at least one of said gas or liquid phases or the level of liquid in the means for reducing turbulence whereby said signal is employed to control the operation of said ejector means.

16. A device according to claim 14, wherein said ejector means has two convergent mechanisms which are operatively associated with a control mechanism for providing channel-forming sections that can be adjusted independently of one another within said ejector means.

* * * * *